US005092639A

United States Patent [19]

Di Giusto

[11] Patent Number: 5,092,639

[45] Date of Patent: Mar. 3, 1992

[54] LOCK REQUIRING REDUCED OPENING FORCE

[75] Inventor: Nevio Di Giusto, Venaria, Italy

[73] Assignee: Fiat Auto S.p.A., Turin, Italy

[21] Appl. No.: 746,150

[22] Filed: Aug. 14, 1991

Related U.S. Application Data

[63] Continuation-in-part of Ser. No. 545,706, Jun. 29, 1990, abandoned.

[30] Foreign Application Priority Data

Jul. 4, 1989 [IT] Italy ..... 53213/89[U]

[51] Int. Cl.[5] ..... E05C 3/26

[52] U.S. Cl. ..... 292/216; 74/97.1; 292/DIG. 23; 292/210

[58] Field of Search ..... 292/216, 210, DIG. 23, 292/201; 74/97.1

[56] References Cited

U.S. PATENT DOCUMENTS

| | | | |
|---|---|---|---|
| 1,372,331 | 3/1921 | Balzer et al. | 74/97.1 |
| 2,642,506 | 6/1953 | Mucher | 74/97.1 |
| 3,334,934 | 7/1965 | Sandor | 292/216 |
| 4,783,102 | 11/1988 | Bernard | 292/216 |
| 4,917,420 | 4/1990 | Rogers, Jr. | 292/216 |
| 4,948,184 | 8/1990 | Weyerstall et al. | 292/201 |

FOREIGN PATENT DOCUMENTS

| | | | |
|---|---|---|---|
| 2009604 | 9/1971 | Fed. Rep. of Germany . | |
| 2372299 | 6/1978 | France . | |
| 2401295 | 4/1979 | France | 292/216 |
| 2402757 | 4/1979 | France | 292/216 |
| 2472651 | 7/1981 | France . | |

*Primary Examiner*—Renee S. Luebke
*Assistant Examiner*—Darnell M. Boucher
*Attorney, Agent, or Firm*—Shlesinger, Arkwright & Garvey

[57] ABSTRACT

The lock is formed from a fork which engages a striker pin and is itself engaged at one end by a catch; its main characteristic is that between the fork and catch there is interposed a rotatable insert which pivots at one end against the catch and is arranged to cooperate at its other end with the hook-shaped end of the fork, the insert being dragged rigidly with the catch by a spring connected to the insert eccentric to the position in which this latter pivots against the catch.

14 Claims, 2 Drawing Sheets

LOCK REQUIRING REDUCED OPENING FORCE

This application is a continuation-in-part of application Ser. No. 07/545,706, filed June 29, 1990, now abandoned.

BACKGROUND OF THE INVENTION

This invention relates to a vehicle lock requiring a reduced opening force.

Vehicle locks are known to comprise essentially a striker pin usually fixed on the pillar of the door opening, a rotatable fork engaging the striker pin at the moment the door is closed and usually carried on this latter, and a catch mounted to the side of the fork and arranged to cooperate with it after closure, to prevent its rotation and thus keep the lock fastened. During opening, to disengage the catch from the fork and thus allow this latter to freely rotate, usually under the effect of the return force generated by elastic means, it is necessary to overcome the force acting between the fork and catch due to the friction generated between the catch and the fork by the elastic reaction of the perimetral door gaskets. This force can be considerable, so that in the case of a manually operated lock the user has to apply a certain force to open the door, a fact which can disturb the user because it gives the impression that the lock, which is thus "hard", is operating incorrectly, therefore generally reducing the degree of comfort of the vehicle.

SUMMARY OF THE INVENTION

The object of the invention is to provide a vehicle lock requiring the use of only a small opening force, even if the forces acting between the fork and catch are relatively high.

Said object is attained according to the invention by a vehicle lock, of the type comprising a striker pin, a rotatable fork which engages said pin, and a catch arranged to prevent the rotation of said fork when it engages said pin, characterized by also comprising a rotatable insert which pivots at a first end against the catch in such a manner as to be interposed between the fork and catch when the fork engages said pin; said insert being arranged to cooperate, by means of its second end distant from the first, with a hook-shaped portion of the fork, and being dragged rigidly with the catch by a spring connected to the insert eccentric to the position in which this latter pivots against the catch.

BRIEF DESCRIPTION OF THE DRAWINGS

The invention will be more apparent from the non-limiting description of two embodiments thereof given hereinafter with reference to the accompanying drawings in which:

In FIGS. 1, 2, 3 and 4 the reference numeral 1 indicates overall a lock for a vehicle 2 of any type, the lock being shown schematically in terms only of its main components, the remaining details being known and therefore not shown for simplicity. The lock 1 comprises a striker pin 4, for example fixed to the upright of a door opening 5 of the vehicle 1, a fork 6 carried for example by a door 8 of the vehicle 1 such that it can rotate about a pin 7 (FIG. 3) which is parallel to the pin 4 when the lock 1 is closed, and a catch 10 supported rotatably on a pin 11 which is parallel to the pin 7 and is carried rigidly with this latter by the same element of the vehicle 1, in this case the door 8.

Figure 1:
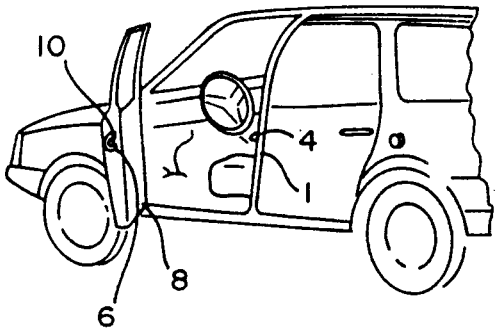
FIG. 1 shows a vehicle provided with the lock according to the invention.
Figure 2:
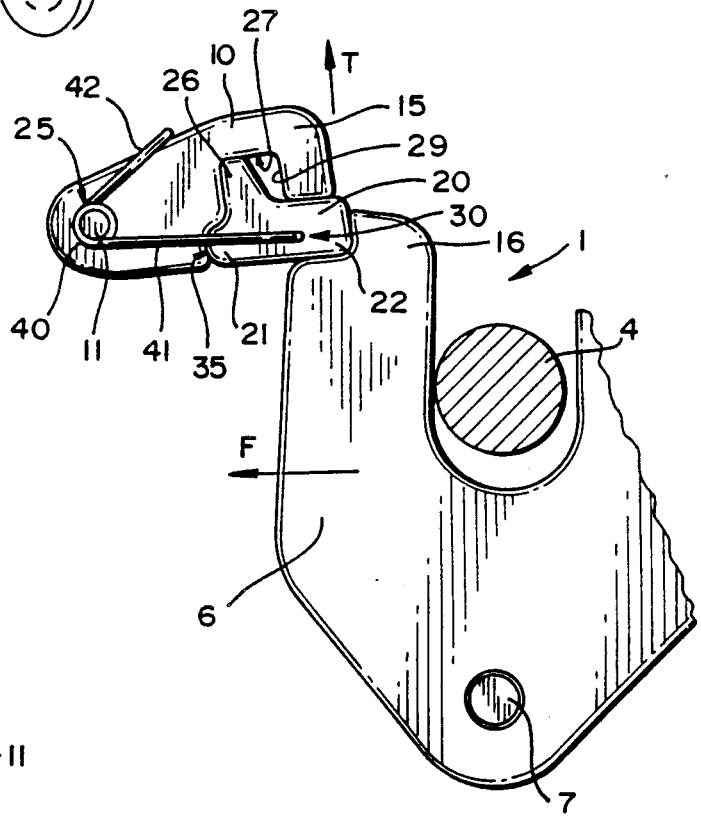
FIG. 2 is a schematic view of the lock according to the invention, showing only the main components thereof.

The catch 10 and the fork 6, which are usually both carried inside a known holder or lock plate, not shown, fixed rigidly to the door 8, and are provided on the pins 7, 11 with elastic opposition means, also of known type and not shown for simplicity, are arranged to cooperate with each other when the lock 1 is closed, i.e. when in the configuration shown in FIG. 2, to prevent rotation of the fork 6. In this respect, this latter, at the moment the door 8 is closed within the opening 5, engages the striker pin 4 in the manner shown, by rotating on the pin 7 against the action of its own elastic return means. When engagement has taken place the catch 10, by the effect of the relative position of the pivot points 7 and 11 and under the action of its own elastic return means, rotates on the pin 11 so that its hook-shaped end 15, distant from the pin 11, engages a corresponding externally hook-shaped end 16 of the fork 6. According to the invention, the cooperation between the catch 10 and fork 6 when the lock 1 is closed is obtained indirectly, in that the lock 1 comprises a rotatable catch or insert 20 which pivots at a first end 21 against the catch 10 so as to be interposed between the fork 6 and the catch 10 when the fork 6 engages the pin 4, i.e. when the lock 1 is closed. The insert 20 also comprises a second end 22, distant from the end 21, by which it cooperates with a hook-shaped portion of the fork 6, defined in the present case by the end 16.

The insert 20 is dragged rigidly with the catch 10 by a spring 25 connected to the insert 20 eccentric to the position in which this latter pivots against the catch 10. Specifically, the insert 20 is provided laterally with a projecting appendix or projection 26 engaged with clearance in a seat or recess 27 provided in the catch 10 and defined by a pair of opposing respective stop shoulders 28 and 29 arranged to cooperate with the appendix 26 to limit the angle through which the insert 20 can rotate. Consequently, the spring 25 is connected to the insert 20 at a point, indicated by 30, which lies to the side of the centre line through the end 21 in the direction of the appendix 26 and is situated closer to the end 22 than is the appendix 26.

In the non-limiting illustrated case, the insert 20 is housed in a concavity 32 defined by the end 15 of the catch 10 and facing the fork 6, and by means of its end 21, under the pulling action of the spring 25, it projectingly engages a recess 35 provided in the catch 10. The end 21 and recess 35 are bounded by a conjugate semicircular profile, such as to define a rotation fulcrum for the insert 20.

Figure 5:
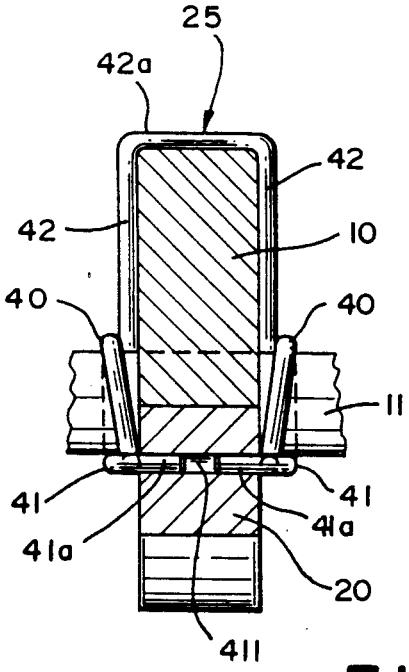
FIG. 5 is an enlarged sectional view taken along line 5—5 of FIG. 3.
Figure 4:
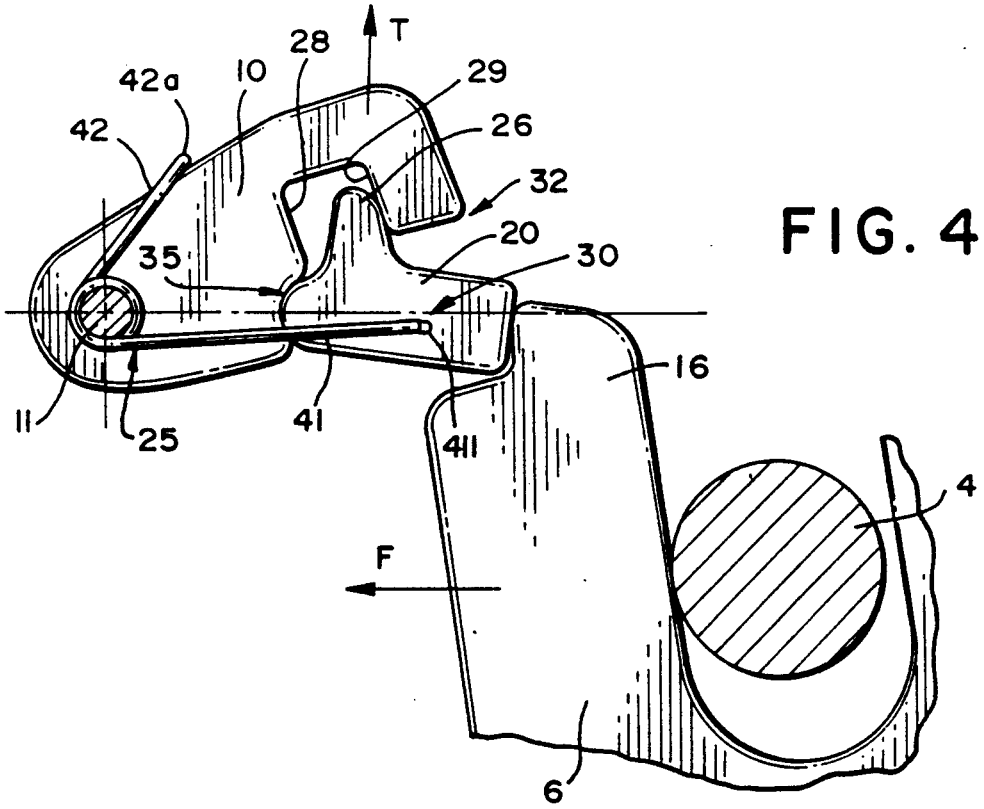

The spring 25 is generally saddle-shaped and includes (FIG. 5) two intermediate portions 40 wound about pin 11 on the opposite sides of catch 10. Each portion 40 is provided with a pair of V-forming or diverging arms 41 and 42. The arm 41 is connected to insert 20 at point 30, and the arm 42 is connected integrally with the corresponding arm 42 of the other side of the spring 25 by a bridge portion 42*a* secured so as to straddle catch 10 at the end thereof lying opposite to insert 20. Each of the arms 41 includes an end portion 41*a* extending substantially at right angle thereto. The end portions 41*a* of both opposed arms 41 of spring 25 are rotatably received in an oblong-shaped slot 411 in insert 20. The end portions 41*a* therefore face each other in slot 411 and are substantially coaxial with one another. As best shown in FIG. 4, since slot 411 is oblong-shaped, and has a width greater than the diameter of each of end portions 41*a*, when catch 10 and insert 20 pivot relative to one another, slot 411 compensates for any play therebetween.

Figure 3:
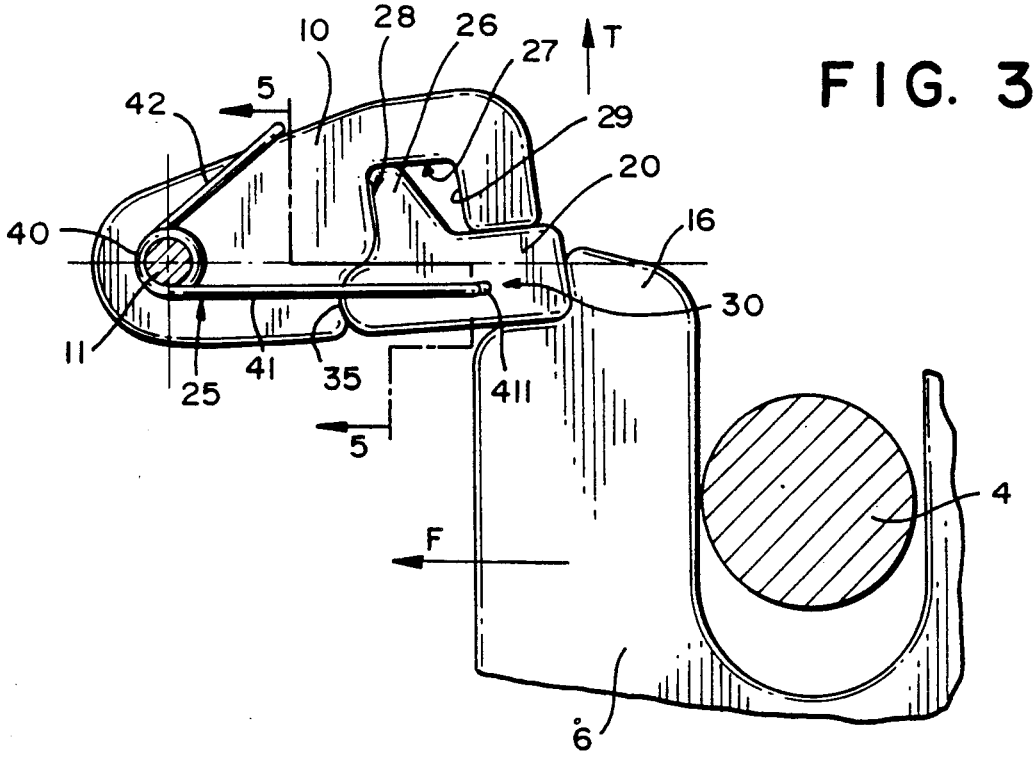
FIGS. 3 and 4 are enlarged views of the lock of FIG. 2, shown in two different operating positions.

When in use, the closure of the door 8 causes the fork 6 to engage the pin 4 followed by the descent of the catch 10, the insert 20 of which cooperates by means of its end 22 with the end 16, to consequently secure the fork 6 and fasten the lock 1. In this configuration, (FIG. 3) insert 20 is kept by the action of spring 25 against shoulder 28 because spring 25 acts in order to close its arms 41 and 42 of each side thereof towards each other, and the fork 6 and catch 10 act on each other by way of the insert 20 with a force F, which is applied to the fork 6 by the elastic reaction of the perimetral gaskets of the door 8. To open the lock 1, the user is required to manually apply a force T to the catch 10 by way of a known lever system, not shown for simplicity. In the case of the lock 1 the force T is very low and in any event needs to be applied only in the initial stage, the lock 1 opening entirely automatically and independently of the extent of the force F produced by the gaskets, once it has started to do so by virtue of the initial movement of the catch 10.

In this respect, due to the effect of force T, the shoulder 28 of catch 10 causes insert 20 to initially rotate thereby subjecting insert 20 to a component of force F applied by fork 6, so as to rotate insert 20 into the position shown in FIG. 4. And, the appendix or projection 26 of insert 20 is withdrawn from shoulder 28 and comes to rest against shoulder 29. During this stage the force T which has to be applied is very small, as it corresponds substantially to that required to overcome only the friction forces at the fulcrum 35.

The relative rotation between catch 10 and insert 20, also allows fork 6 to undergo a limited rotation allowing insert 20, which functions substantially as a connecting rod, to reach a dead center position, beyond which the force acting between insert 20 and end 16 of fork 6 assume a positive arm about fulcrum 35 causing insert 20 to spontaneously snap against shoulder 29 and thus complete its rotation so as to assume the position shown in FIG. 4. This rotation results in the creation of a component of the force acting between the insert 20 and end 16 in the same direction as the force T, to therefore cause the catch 10 to withdraw with consequent disengagement of the block 20 from the end 16, so leaving the fork 6 to rotate and disengage from the pin 4, with consequent opening of the lock 1. As soon as insert 20 disengages from fork 6, spring 25 restores the initial position of insert 20 against shoulder 28 thereby enabling catch 10-insert 20 complex to engage fork 6 again during the closure of door 8, as described above.

The advantages of the invention are apparent from the aforegoing description. By simply interposing the insert 20 between the catch and fork, and retaining the insert in the described manner, a lock is obtained which is of equal reliability and operability to known locks but which requires the use of a considerably reduced opening force (with the lock opening by itself after the initial stage), to the advantage of user comfort. This is obtained at very low cost, as the general architecture of the lock is not changed.

I claim:

1. A lock for latching or unlatching a closure panel of a vehicle in cooperation with a fixed member, the lock comprising:

a) rotatable fork means in selective engagement with the fixed member for latching or unlatching a closure panel;

b) first and second cooperating catch means in operative engagement with said fork means for allowing or preventing a rotation of said fork means when said fork means is in engagement with the fixed member;

c) said second catch means being disposed between said first catch means and said fork means and including first and second ends;

d) said first end of said second catch means being in pivotable engagement with said first catch means;

e) said second end of said second catch means selectively engaging a portion of said fork means; and f) spring means extending from said second catch means to said first catch means.

2. The lock of claim 1, wherein:

a) said first catch means includes a recess; and b) said second catch means includes a projection member rotatably received in said recess.

3. The lock of claim 2, wherein:

a) said projection member includes first and second positions; and b) means for limiting rotation of said projection member between said first and second positions.

4. The lock of claim 1, wherein:

a) said first catch means includes a slot; and b) said second catch means includes a section received in said slot for pivoting thereabout.

5. The lock of claim 4, wherein:

a) said second catch means includes a projection member extending generally transverse to said section thereof; and b) said projection member includes first and second positions;

c) whereby said projection member rotates to assume one of said first and second positions when said second catch means pivots relative to said first catch means.

6. The lock of claim 1, wherein:

a) said spring means includes first and second arms; and b) said first arm includes a saddle-shaped portion for securing over said first catch means.

7. The lock of claim 1, wherein:

a) said second catch means includes a slot; and b) said spring means includes a section pivotably received in said slot.

8. The lock of claim 7, wherein:

a) said slot is disposed in said second catch means adjacent said second end thereof.

9. The lock of claim 8, wherein:

a) said slot is generally oblong in configuration.

10. The lock of claim 1, wherein:

a) said first catch means includes a mounting pin;

b) said spring means includes an intermediate portion securely wound about said pin; and c) said spring means includes first and second arms divergely extending from said intermediate portion.

11. The lock of claim 10, wherein:

a) said first arm comprises a saddle-shaped portion for securing over said first catch means;
b) said second catch means includes an oblong-shaped slot; and
c) said second arm includes an end portion pivotably received in said slot.

12. The lock of claim 3, wherein:
a) said recess includes a pair of opposed abutment surfaces; and
b) said rotation limiting means comprises said abutment surfaces.

13. A lock for latching or unlatching a closure panel of a vehicle in cooperation with a fixed member, the lock comprising:
a) rotatable fork means in selective engagement with the fixed member for latching or unlatching a closure panel;
b) first and second cooperating catch means in operative engagement with said fork means for allowing or preventing a rotation of said fork means when said fork means is in engagement with the fixed member;
c) said second catch means including first and second ends;
d) said first end of said second catch means being in pivotable engagement with said first catch means;
e) said second end of said second catch means selectively engaging a portion of said fork means; and
f) spring means extending from said second catch means to said first catch means.

14. A lock for latching or unlatching a closure panel of a vehicle in cooperation with a fixed member, the lock comprising:
a) rotatable fork means in selective engagement with the fixed member for latching or unlatching a closure panel;
b) first and second cooperating catch means in operative engagement with said fork means for allowing or preventing a rotation of said fork means when said fork means is in engagement with the fixed member;
c) said second catch means including first and second ends;
d) said first end of said second catch means being in pivotable engagement with said first catch means;
e) said second end of said second catch means selectively engaging a portion of said fork means;
f) spring means extending from said second catch means to said first catch means; and
g) said spring means pivotably securing said second catch means against said first catch means.

* * * * *